US008576034B2

(12) United States Patent
Bilbrey et al.

(10) Patent No.: US 8,576,034 B2
(45) Date of Patent: Nov. 5, 2013

(54) ALIGNMENT AND CONNECTION FOR DEVICES

(75) Inventors: Brett Bilbrey, Sunnyvale, CA (US); Aleksandar Pance, Saratoga, CA (US); Peter Arnold, Cupertino, CA (US); David I. Simon, San Francisco, CA (US); Jean Lee, San Jose, CA (US); Michael D. Hillman, Los Altos, CA (US); Gregory L. Tice, Los Altos, CA (US); Vijay Iyer, Mountain View, CA (US); Bradley Spare, San Jose, CA (US)

(73) Assignee: Apple Inc., Cupertino, CA (US)

( * ) Notice: Subject to any disclaimer, the term of this patent is extended or adjusted under 35 U.S.C. 154(b) by 12 days.

(21) Appl. No.: 13/188,428

(22) Filed: Jul. 21, 2011

(65) Prior Publication Data

US 2012/0028480 A1 Feb. 2, 2012

Related U.S. Application Data

(60) Provisional application No. 61/366,466, filed on Jul. 21, 2010.

(51) Int. Cl.
*H01F 7/20* (2006.01)
*H01F 7/02* (2006.01)

(52) U.S. Cl.
USPC ..... 335/285; 335/306; 439/39

(58) Field of Classification Search
USPC ..... 335/285–295, 302–306; 24/303; 439/28–40
See application file for complete search history.

(56) References Cited

U.S. PATENT DOCUMENTS

| | | | | |
|---|---|---|---|---|
| 5,812,356 | A * | 9/1998 | O'Connor | 361/179 |
| 5,921,783 | A | 7/1999 | Fritsch et al. | |
| 6,561,815 | B1 | 5/2003 | Schmidt | |
| 7,817,003 | B2 * | 10/2010 | Fullerton et al. | 335/306 |
| 7,834,729 | B2 * | 11/2010 | Fullerton et al. | 335/306 |
| 7,868,721 | B2 * | 1/2011 | Fullerton et al. | 335/284 |
| 8,018,105 | B2 | 9/2011 | Erixon et al. | |
| 8,177,560 | B2 * | 5/2012 | Rohrbach et al. | 439/39 |
| 8,179,219 | B2 | 5/2012 | Fullerton et al. | |
| 8,348,678 | B2 | 1/2013 | Hardisty et al. | |
| 2006/0151990 | A1 | 7/2006 | Cowburn | |
| 2009/0128503 | A1 | 5/2009 | Grant et al. | |
| 2010/0302199 | A1 | 12/2010 | Taylor et al. | |
| 2012/0021619 | A1 | 1/2012 | Bilbrey et al. | |
| 2012/0023597 | A1 | 1/2012 | Bilbrey et al. | |
| 2012/0028480 | A1 | 2/2012 | Bilbrey et al. | |
| 2012/0031153 | A1 | 2/2012 | Conti | |
| 2012/0032765 | A1 | 2/2012 | Bilbrey et al. | |
| 2012/0155803 | A1 | 6/2012 | Benjamin et al. | |
| 2012/0163754 | A1 * | 6/2012 | Benjamin et al. | 385/33 |
| 2013/0076652 | A1 | 3/2013 | Leung | |

FOREIGN PATENT DOCUMENTS

| | | |
|---|---|---|
| FR | 2944613 | 10/2010 |
| KR | 20100138219 | 12/2010 |

* cited by examiner

*Primary Examiner* — Bernard Rojas
(74) *Attorney, Agent, or Firm* — Brownstein Hyatt Farber Schreck, LLP

(57) ABSTRACT

A plug or connector including a coded magnet and an electrical contact. As the plug approaches a corresponding port, the coded magnet interacts with a magnet within the port. The interaction between the plug coded magnet and the port coded magnet provides a force to connect and/or align the plug with the port. Once the plug is received within the port, if a process is completed, the coded magnets polarities are altered to eject the plug from the port.

29 Claims, 9 Drawing Sheets

ALIGNMENT AND CONNECTION FOR DEVICES

CROSS-REFERENCE TO RELATED APPLICATIONS

This application claims the benefit under 35 U.S.C. §119 (e) to of U.S. Provisional Patent Application No. 61/366,466, filed Jul. 21, 2010 and titled, "Applications of Programmable Magnets," the disclosure of which is hereby incorporated herein in its entirety. This application is also related to U.S. patent application Ser. No. 13/188,429, filed with and titled "Magnetically-Implemented Security Devices," U.S. patent application Ser. No. 13/188,432, filed with and titled "Magnetic Fasteners" and U.S. patent application Ser. No. 13/188,436, filed with and titled "Programmable Magnetic Connectors," all filed on the same day as this application and all of whose disclosures are hereby incorporated herein in their entireties.

TECHNICAL FIELD

Embodiments discussed herein relate generally to programmable magnetic devices, and more particularly to multipart devices that may be joined or separated through programmable magnets.

DETAILED DESCRIPTION

"Correlated magnets" or "coded magnets" are magnetic structures formed of multiple individual magnetic elements, each of which has both a north and a south pole. The individual magnetic elements may vary in terms of which pole faces a surface of a coded magnet 10. Thus, a single coded magnet 10 may have multiple magnetic poles on a single surface, and these multiple magnetic poles may cooperate to form a pattern of north and south poles.

Figure 1:
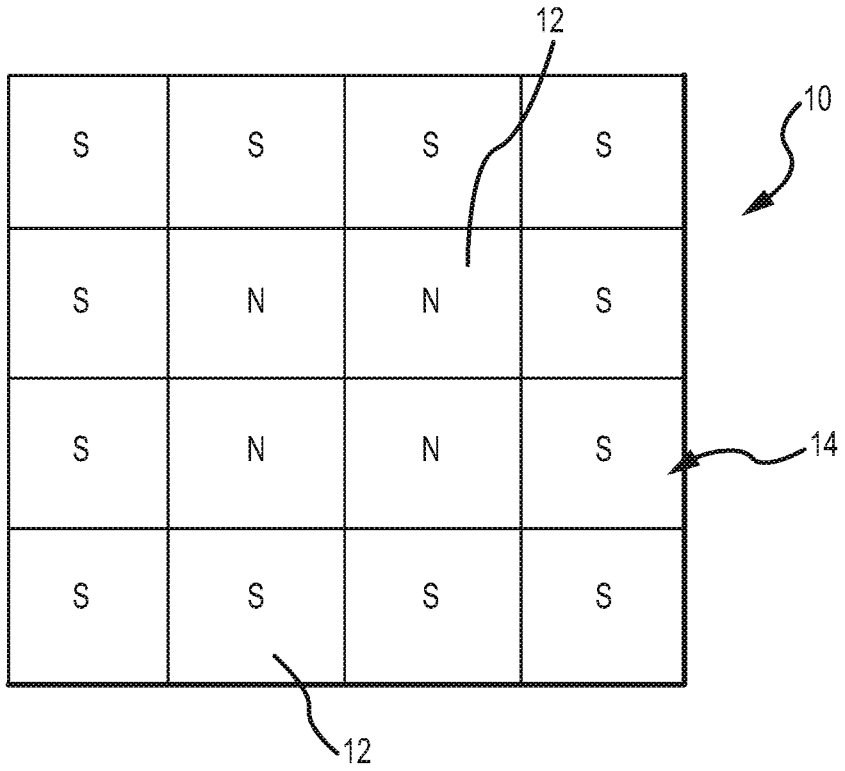
FIG. 1 depicts a coded magnetic structure made from a four-by-four grid of maxels 12.

As one example, picture a four-by-four grid, with each portion of the grid being occupied by a separate magnetic element. (FIG. 1 shows such an example.) The outer portion of this grid may include magnetic elements having their south poles facing in a common direction, such as toward the viewer with respect to FIG. 1. Likewise, the center two-by-two portion of the grid may contain magnetic elements with their north poles facing toward the viewer with respect to FIG. 1. In this example, the magnetic elements combine to create a coded magnet 10 with magnets presenting their south poles (e.g., negative polarities) toward an exposed surface and ringing four magnets presenting their north poles (e.g., positive polarities) toward the same exposed surface. The constituent magnetic elements may be referred to herein as "maxels" 12.

It should be appreciated that the overall magnetic field of the coded magnet 10 will depend on the arrangement of the constituent magnetic elements or maxels 12. Certain correlated magnets may exert a repulsive force at a first distance against an external magnetic or ferrous surface, but an attractive force at a second distance. The exact distances at which a coded magnet 10 may be magnetically attractive or repulsive generally depend on the arrangement and strength of each individual maxel 12. By properly positioning maxels 12 on a coded magnet 10 surface 14, a force curve having particular attractive and repulsive strengths at certain distances may be created. It should likewise be noted that the force curve may switch between attraction and repulsion more than once as the separation distance between the coded magnet 10 and magnetic surface increases or decreases.

Generally, the coding of a correlated magnetic surface (e.g., the placement of maxels 12 having particular field strengths and polarities) creates a particular two-dimensional pattern on the surface and thus a three-dimensional magnetic field. The three-dimensional magnetic field may serve to define the aforementioned force curve, presuming that the external magnetic or ferrous surface has a uniform magnetic field.

Further, the two-dimensional pattern of the coded magnetic surface 14 generally has a complement or mirror. This complement is the reversed maxel 12 pattern of the coded magnetic surface 14. Thus, a complementary coded magnetic surface may be defined and created for any single coded magnetic surface 14. A coded magnetic surface 14 and its complement are generally attractive across any reasonable distance, although as the separation distance increases the attraction attenuates. With respect to a uniform external magnetic or ferrous surface, the force curve of a complementary coded magnet is the inverse of the original coded magnet 10's force curve. The force curve between two coded magnets may be varied by misaligning pairs of magnets, magnet strengths and the like, yielding the ability to create highly variable, and thus tailorable, force curves.

Since the maxel 12 pattern of a coded magnet 10 varies in two dimensions, rotational realignment of an external magnetic surface 14 (including a complementary coded magnet) may relatively easily disengage the coded magnet 10 from the external magnetic surface. The exact force required to rotationally disengage two coded magnets, or a coded magnet and a uniformly charged external surface, may be much less than the force required to pull the two apart. This is because rotational misalignment likewise misaligns the maxels 12, thereby changing the overall magnetic interaction between the two magnets.

Further, it should be appreciated that coded magnets may be programmed or reprogrammed dynamically by using one or more electromagnetic maxels 12 to form the coded surface pattern. As current is applied to the electromagnetic maxels 12, they will produce a magnetic field. When no voltage is applied, these maxels 12 would be magnetically inert. When the input current is reversed, the polarity of the maxels 12 likewise reverses. Thus, the coding of the coded magnet 10 may be changed through application of electricity. Further, any single electromagnetic maxel 12 yields many possible codings presuming all other maxels 12 remain constant: a first coding for the coded magnetic surface 14 when the electromagnetic maxel 12 is attractive, a second when the current is reversed and the electromagnetic maxel 12 is repulsive, and a third when no current is applied and the electromagnetic maxel 12 is neutral. By varying the position of the maxel 12 on the coded magnet 10 and/or the current supplied to the maxel 12, even more variations may be obtained. Given a coded magnet 10 having a five-by-five maxel array (for example), the number of possible codings if all maxels 12 are electromagnets, held in a fixed position and supplied with a fixed current is $3^{25}$, or 847,288,609,443 possible codes at any given moment. Since the coding of the surface 14 may be adjusted dynamically, certain embodiments discussed herein may change their magnetic fields on the fly and thus their force curves. Specific implementations of this concept are discussed herein, although those of ordinary skill in the art will appreciate that variations and alternate embodiments will be apparent upon reading this disclosure in its entirety.

Given the foregoing discussion of coded magnet, it should be appreciated that such magnetic surfaces 14 may be incorporated into a variety of devices, apparatuses, applications and so on to create or enhance functionality of one sort or another. Certain embodiments using coded magnets and the function of these embodiments will now be discussed.

Cables and Plugs

Certain embodiments may take the form of cables or plugs incorporating coded magnets. Cables may have coded magnets at one or both ends and/or along one or more portions of the cable body. Similarly, the plugs may include a coded magnet 10 along its entire body, its face or a portion of either the face or body. In the event the coded magnets are situated along the body of the cable or plug, they may be laid out in strips, spirals, helices, geometric shapes and so on. Likewise, coded magnets located at one or both ends of the cable or plug may be arranged in a variety of sizes, shapes and patterns. The sizes, shapes and/or patterns of the coded magnets on the cable may be chosen to create a specific attractive/repulsive force curve.

As one example, many computers and devices made by Apple Inc. employ MagSafe connectors at the ends of cables. The MagSafe connector magnetically couples the cable to the appropriate device port in the appropriate position and/or configuration, but will decouple when sufficient force is exerted on the cable or device in order to avoid accidentally jerking or moving the device. By using a coded magnet 10 for the MagSafe connector cord (or in place thereof) and a complementary coded magnet 10 within the device port, the union between the connector and device port may be made more secure. Further, by using a properly coded maxel arrangement for both coded magnets, the device port may actually attract or "suck in" the MagSafe connector from a distance. Further, the device port may repel a connector/cord that has a differently-coded coded magnetic surface 14. These type of plug/port examples are discussed in more detail below with respect to FIGS. 6A-8.

In addition, cables and cords described herein may have coded magnets that permit easy disengagement from a port. The cable's coded magnet may generate a force curve that reduces the attractive force significantly, or even creates a repulsive force, when it rotates with respect to a coded magnet within the port. In this manner, the cable may disengage rather than pull an attached device off a table when the cord is sharply tugged or yanked.

Similarly, each port of a device may incorporate a coded magnet 10 having a different maxel pattern. Cords or plugs configured to mate with a particular port may have a complementary or attractive maxel pattern, such that the cords or plugs may mate with that port but be repulsed by other ports. Further, certain cords may be designed to mate with multiple ports and may have a maxel pattern that, at least at certain distances (such as a relatively close distance), is attracted by the coded magnet of each such port.

These certain cords may have coded magnets at, in or proximate one end that permit them to detect an appropriately configured coded magnet in a nearby port of a device. Presuming the force curve is sufficiently attractive, the coded magnet in the cable may "home in" on the coded magnet in the port, physically moving the cable toward the port. In certain cases, the attraction is sufficient to dock or mate the cable to the port. Presuming that each cable is magnetically coded to be so attracted only to the port with which it is designed to interface, a cable may "home in" only on the proper port and ignore the others, thereby ensuring each cable is properly connected to a device.

Figure 6A:
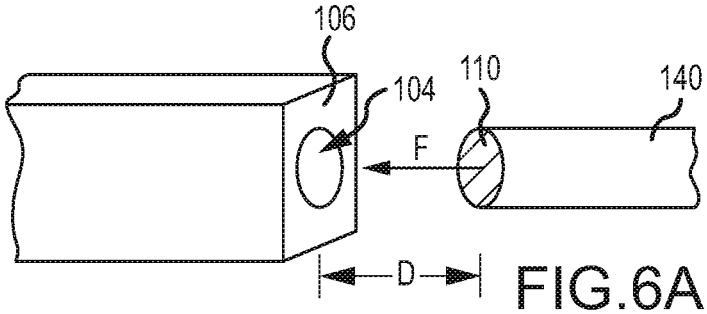
FIG. 6A depicts a plug having a coded magnetic structure aligned with a corresponding port for a device.

FIG. 6A is a diagram illustrating a plug 140 aligned with a corresponding port 104 of a device 106. The device 106 may be substantially any type of electronic device or computer, such as but not limited to, laptop, tablet computer, digital camera, video camera, MP3 player. Similarly, the plug 140 may be substantially any type of electronic connector or provide electrical communication between two devices or a device and a computer.

The plug 140 includes a coded magnet 110 on its terminal end and the port 104 includes a corresponding coded magnet. As the plug 140 approaches the port 104, the coded magnet 110 is configured so that at a distance D, the port 104 pulls the plug 140 forward via a magnetic force between the plug coded magnet 110 and the port 140 coded magnet. This force may help to direct the plug 140 towards the port 140 to assist the plug 140 in being received within the port 104 or "home in" on the port 104. As the force directs the plug 140 into the port 104, it may help to prevent the plug 140 from being inserted into an erroneous port, as it assists in directing the plug 140 towards the correct port 104.

Figure 6B:
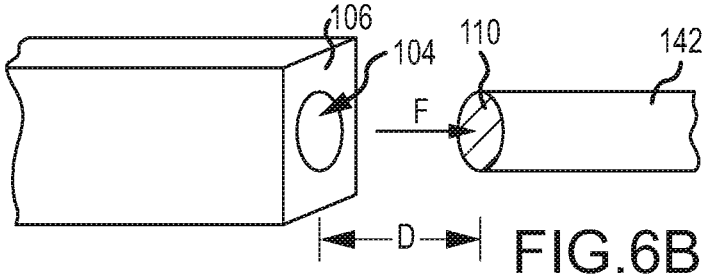
FIG. 6B depicts a plug having a coded magnetic structure aligned with a non-corresponding port for a device.

Similarly, as shown in FIG. 6B, if an incorrect or non-corresponding plug 142 is attempted to be inserted into the port 104, the coded magnet 110 on the plug 142 may be forced away from the port 104 by a corresponding coded magnet within the port 104. This may help to prevent the plug 142 (which does not correspond to the port 104) from being inserted into the port 104.

Some electronic devices require complex plug, cable and port connections. For example, a receiver for a stereo system may have multiple ports to receive speaker cables, video input/output cables, audio input/output cables and so on. Some users may have difficulty in determining a cable and plug combination that should be inserted into a particular port. As shown in FIGS. 6A and 6B, in examples when the plugs 140, 142 and the port 110 include a coded magnet the plugs 140, 142 and/or port 104 may be configured to attract a corresponding mate and repel a non-corresponding mate.

This may assist the user is properly connecting each plug and cable to the corresponding port. For example, a user may need to place a plug 140 near a port 104 to determine if the plug 140 is configured to be received within the port 104.

Figure 7A:
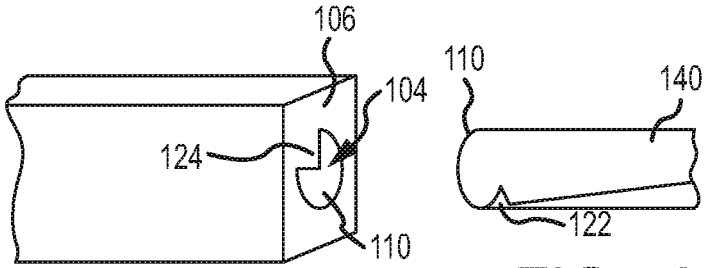
FIG. 7A depicts a plug having a coded magnetic structure and a keying structure unaligned with a keying structure of a corresponding port.
Figure 7B:
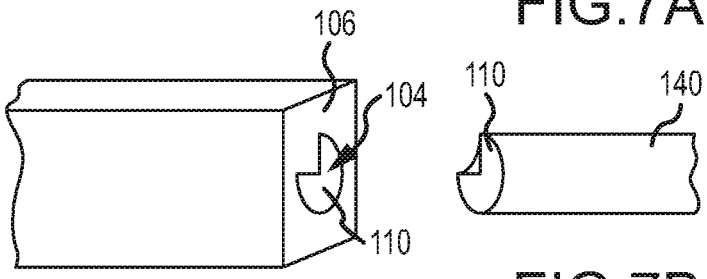
FIG. 7B depicts the plug of FIG. 7A aligned with the keying structure of the corresponding port.

Additionally, as discussed briefly above, in some examples a plug and/or cable may use coded magnets to assist the plug in aligning with the port. As shown in FIGS. 7A and 7B, the plug 140 may have a key structure 122 that may correspond to a particular key structure 124 in the port 104. Referring to FIG. 7A, as the plug 140 approaches the port 104, the key structures 122, 124 are misaligned. Due to the keying structures' 122, 124 physical structure, if the plug 140 or port 104 are not re-aligned, the plug 140 may not be properly received within the port 104. However, the plug 140 and port 104 may each include a coded magnet 110 so that, as the plug 140 approaches the port 104, the coded magnets 110 may interact to rotate the plug 140. The coded magnets may dynamically switch polarities as a current is applied to provide alternating polarities in order to provide a rotational force to the plug 140. Alternately, the coded magnets 110 may simply pull a particular side of the plug 140 towards an aligned side of the port 104. As still another option, the magnetic force generated by the two coded magnets may cooperate to impart rotation to the plug 140. Then, as shown in FIG. 7B, the keying structures 122, 124 may be aligned as the plug approaches the port 104 (or when the plug 140 is partially received therein).

In one example, the plug 140 and the port 104 may not align until the plug 140 is at least partially received within the port 104. For example, the plug 140 may be partially inserted, the coded magnets 110 then may switch polarities to provide varying forces and, next, the plug 140 may be completely received within the port 104.

In another example, a surface of the port 104 may include the coded magnet and a surface of the plug 140 may include a corresponding coded magnet 110. As the plug 140 is inserted, the two coded magnets 110 may pull towards each other, possibly rotating the plug 140. In some embodiments, the plug and port may attract one another at a first distance and repulse one another beyond the first distance, such that the port and plug attract one another when sufficiently close. It should be appreciated that such structures may attract and/or repel one another without any rotation.

The distance at which the plug 140 may be aligned with the port 104 may depend on the strength of the coded magnets 110 and their corresponding magnetic force. However, in still other examples, as shown in FIG. 7B, the plug 140 may be aligned with the keying structure 124 prior to being partially received within the port 104.

As the plug 140 and port 104 use the coded magnets 110, a device may use the same plug or port for different signals or data and depending on the current data communication desired, the coded magnets 110 may switch polarities to be received within the corresponding port 104 for the particular data communication.

Figure 8:
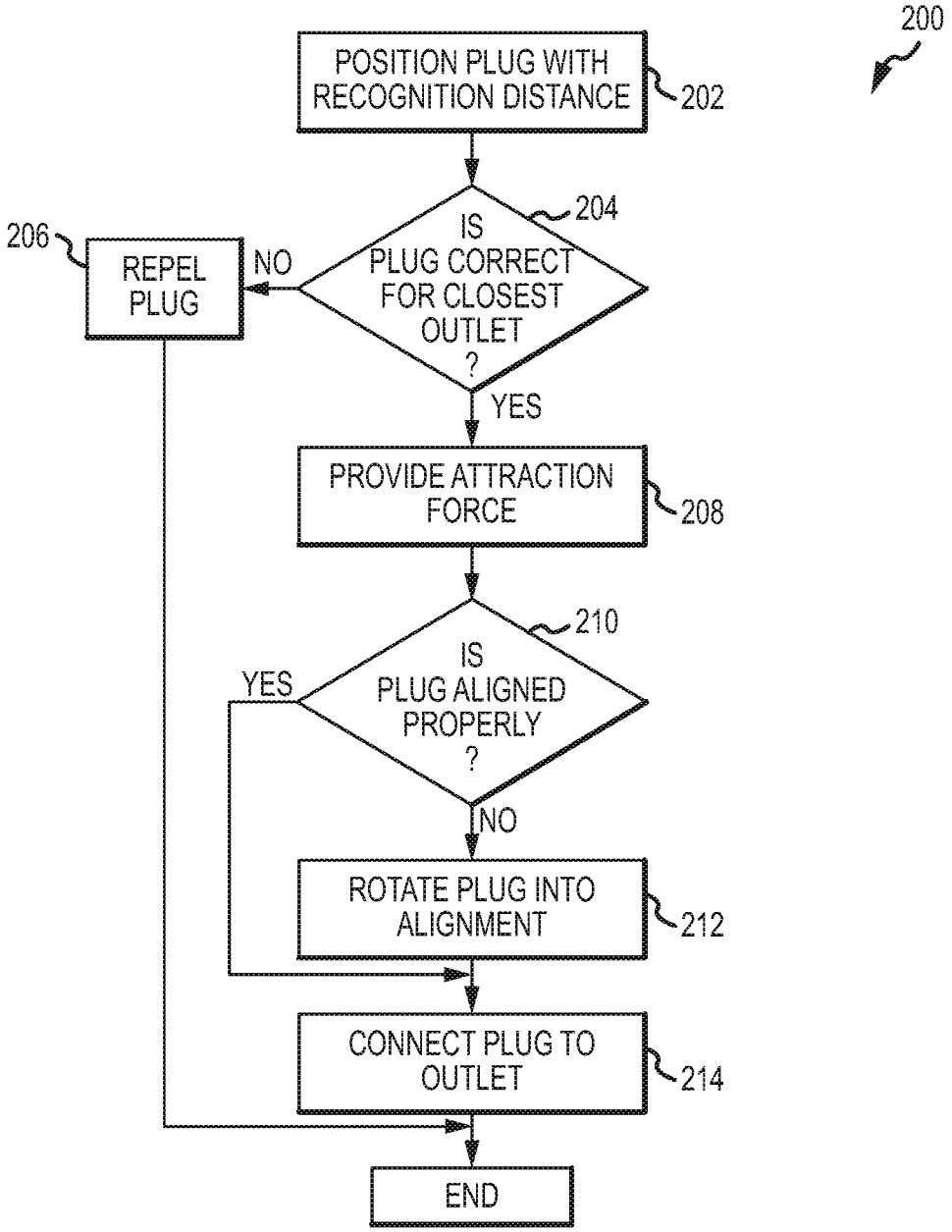
FIG. 8 is a flow chart illustrating a method for providing connecting a plug with a corresponding port.

FIG. 8 is a flow diagram illustrating a method 200 for providing a "home in" functionality and/or alignment assistance for a plug or cable with respect to a port. The method 200 may begin with operation 202, in which the plug 140 may be detected within a recognition distance. As discussed above, the magnetic force of a coded magnet 110 or magnet may have a minimum distance in order to be activated; that is, if the a magnet and maxel are too far apart no force would be felt. Once the plug 140 is detected within the recognition distance, the method 200 may proceed to operation 204.

Operation 204 determines whether the plug 140 is a mate or otherwise corresponds to a port. The plug 140 may not be a mate for the port 104 into which a user may be attempting to insert it. In this instance, the method 200 may proceed to operation 206 and the port 104 may repel the plug 140. As discussed above with respect to FIGS. 6A and 6B, the coded magnets 110, 112 and/or magnet combinations of the plug 140 and port 104 may interact with one another to produce opposite polarities so that the a magnetic force F may repel the port 104 and the plug 140 from one another. This repulsion may substantially prevent the plug 140 from being inserted into the port 104, or at least alert a user to the fact that the plug 140 does not correspond to the port 104 through physical feedback.

Alternately, if the plug 140 is a mate (or otherwise corresponds) to the port 104, the method 200 may proceed to operation 208 and the coded magnets 110, 112 may provide an attraction force F, pulling the plug 140 and the port 104 closer together. For example, as shown in FIG. 6A, the attraction force F reacts with the coded magnet 110 on the plug 140 towards the port 104.

As the plug 140 is pulled towards the port 104, the method 200 may proceed to operation 210. Operation 210 determines whether the plug 140 is aligned correctly with the port. As shown in FIGS. 7A and 7B, in some instances the plug 140 and/or port 104 may include a keying structure 122, 124 that may correctly align the plug 140 within the port 104. As the plug 140 approaches the port 104, the coded magnets 110, 112 may provide a force to rotate the plug 140 based on a magnetic force with a coded magnet 110 within the port 104. For example, the maxels of a coded magnet may exert a magnetic force that may cause the plug 140 to rotate in order to align the attracting polar forces of the maxels 12, e.g., by rapidly switching polarities of some of the maxels 12.

In another example, the port 104 may include a coded magnet positioned on an inner side surface adjacent the keying structure 124 and the plug 140 may include a coded magnet 110 (or non-coded magnet) positioned on a similar location near its keying structure 122. Therefore, as the coded magnets respond to one another, an attractive force may cause the plug 140 to rotate so that the locations of the coded magnets 110 are aligned, thereby aligning the keying structures 122, 124.

Figure 9A:
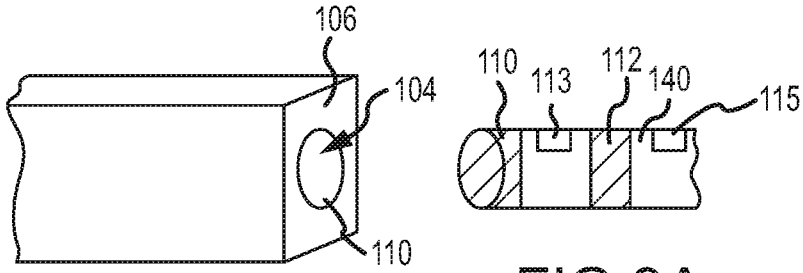
FIG. 9A depicts a plug having multiple electrical contacts and multiple coded magnetic structures corresponding to a port with a coded magnetic structure.
Figure 9B:
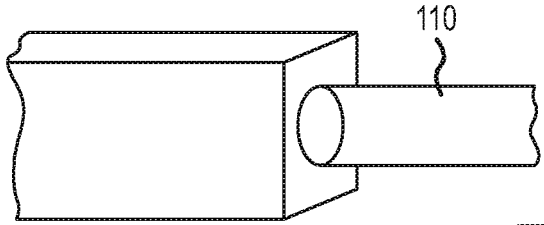
FIG. 9B illustrates the plug of FIG. 9A received within the port.
Figure 9C:
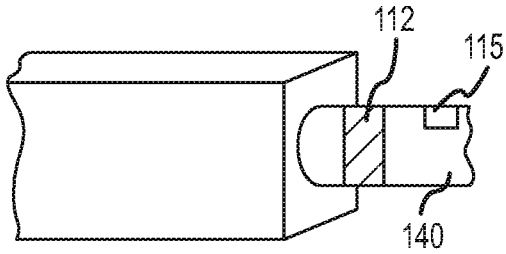
FIG. 9C illustrates the plug of FIG. 9A partially ejected from the port.

FIGS. 9A-9C illustrate an alternative embodiment for utilizing coded magnets for a cable or a plug 140 in order to eject the plug or cable from the port. The port 104 may eject (either partially or completely) the plug 140 to indicate a status change, application notification, or the like. For example, if the plug 140 provides an electrical connection between a peripheral device (such as, camera, MP3 player, phone) and a computer, the port 104 may eject the plug 140 as a notification (such as, charge complete, sync complete, data transfer complete).

FIG. 9B illustrates a plug 140 completely received within the port 104, with both coded magnets 110, 112 received into the port 104. In one example, this insertion position may allow both a first contact 113 and a second contact 115 to be connected to a corresponding connector within the port 104.

FIG. 9C illustrates that the plug 140 has two different coded magnets 110, 112 and two different electrical contacts 113, 114 and the plug 140 is partially ejected from the port 104. In this example, the second contact 115 on the plug 140 may be disconnected from a corresponding port 104 contact (not shown), but the first contact 113 may continue to be connected. For example, the first contact 113 may be a data connector to allow the device to transfer or sync data to and from a computer and the second contact 115 be a charging connector to provide power to a peripheral device. In some instances a device may be completely charged before its information or data sync with a computer may be completed.

In these instances, one or both of the coded magnets 110, 112 on the plug 140 and within the port 104 may switch polarities and provide a repulsion force. This force may partially eject the plug 140, and disconnect the charging contact 115 from the port 104. This may help prevent the device from overcharging or continue to provide power, although a battery (or other power source) may be full.

The port 104 may have a long electrical contact in order to accommodate the change in depth of the first contact 113 as the plug 140 is partially ejected to maintain an electrical communication with the contact 113. Or, as the plug 140 is partially ejected the first contact 113 may continue its communication with the device 106 via the second contact (not shown) within the port 104.

Additionally, after the sync (or other communication) between the first contact 113 and the port 104 is complete, the coded magnets 110, 112 may again switch polarities to eject the plug 140 completely. In some instances, only one of the coded magnets 110, 112 may change polarities. For example, if the second contact 115 is going to be ejected, the second coded magnet 112 may change polarities. This may allow the plug 140 to be only partially ejected so that the first contact 113 may maintain its electrical connection to the port 104.

In another example, the port 104 may completely eject the plug 140 after any communications or applications are completed and/or if there is a power fault. If a device that the plug 140 is connected to passes a temperature threshold while charging, the coded magnets 110, 112 may switch polarities and prevent power transfer. This may provide a repulsion force between the port 104 and the plug 140, to prevent the plug 140 from being reconnected to the port 104 until the device cools. After the device cools, or another non-threshold instance has occurred (e.g., decrease in temperature) the coded magnets 110, 112 may again switch polarities to provide a force to pull the plug 140 into the port 104 to continue with the prior process, e.g., power charging or synchronization.

Figure 10:
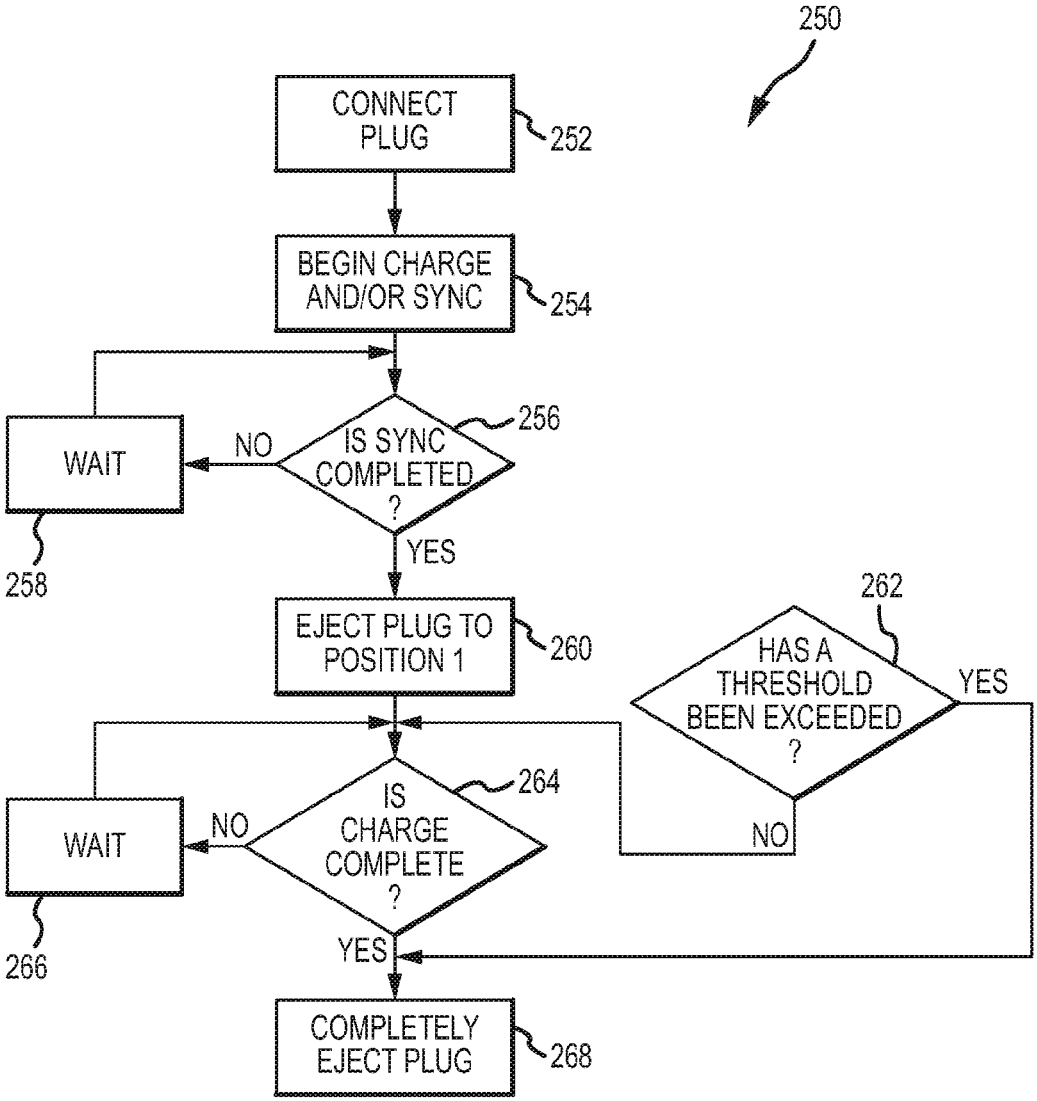
FIG. 10 is a flow chart illustrating a method for ejecting a plug after a completed process.

FIG. 10 is a flow chart illustrating an exemplary method for ejecting the plug 140 connected to a device from the port 104 of a computer. The method 250 may begin with operation 252 and the plug 140 may be connected to the port 104. As discussed in more detail above, with respect to FIGS. 6A-8, the plug 140 may "home in" on the correct port 104 via the coded magnet 110. Once the plug 140 is connected, the method 250 may proceed to operation 256 and computer may determine whether a data sync or other process between the device and the computer is completed. If the process is not yet completed, the method 250 may proceed to operation 258 may wait until the sync or process is completed.

Once the sync or other process is completed, the method 250 may proceed to operation 260. Operation 260 ejects the plug 140 from the port 104 to a first position. The second maxel 112 may switch polarities repelling a corresponding maxel within the port 104, providing a repulsion force to expel at portion of the plug 140. The first position may allow the first contact 113 to remain in communication with the port 104, while the second contact 115 may be disengaged. In one example, this may allow the device to continue to charge (through the first contact 113) although a process (e.g., sync) has been completed and the corresponding contact 115 disengaged.

After operation 256, the method 250 may proceed to operation 262 and the computer or the device may determine a predetermined threshold has been exceeded. For example, the device may have a significant increase in temperature that may damage components of the device while charging, a battery of the device may be fully charged, or the like. If the device exceeds a temperature threshold, the method 250 may proceed to operation 268 and the plug 140 may be fully ejected from the port 104. As discussed above, the coded magnets 110, 112 may provide a repulsion to disengaged the plug 140 away from the port 104. It should be noted that operation 262 may be performed as a check at substantially any time within the method 250.

Additionally, in some examples, after the plug 140 has been disengaged from the port 104 during operation 268 after a set period or time, after the device cools, or another non-threshold instance has occurred, the method 200 may return to operation 252 and the coded magnets 110, 112 may switch polarities to be pulled into the port 104. For example, the plug 140 may be pulled into the port 104 as discussed in FIG. 8 and method 200.

After operation 262, the method 250 may proceed to operation 264 and the device or the computer may determine whether a charging process (or other process) has been completed. For example, the device or computer may determine when the battery is full recharged, or a data transfer has been completed. If the process has not yet completed, the method 250 may proceed to operation 266 and may wait for the process to complete.

Once the process has completed, the method 250 may proceed to operation 268 and the plug 140 may be ejected from the port 104. As the plug 140 ejects it may provide a visual, haptic, and/or audio feedback to a user that a process or processes are completed. For example, after the device is fully charged the connecting plug 140 may eject, alerting a user the device is recharged. Similarly, as the plug 140 may partially eject when a selection or data transfer process (e.g., sync) is complete, a user may have feedback regarding the termination of one process, and a visual indication that another or second process is still continuing. Furthermore, as the plug 140 may be selectively ejected, it may prevent a device from exceeding a temperature, power, charge or other threshold while charging, overcharging, or the like.

Still other embodiments may take the form of a programmable cable. That is, the cable may detect the flux and/or polarity of each individual maxel in a coded magnet 10 of a port, or may detect an overall flux, strength or the like for the coded magnet 10 as a whole. In one embodiment, the cable may perform this detection by rapidly switching the maxel patterns of its own coded magnet 10 until they complement the pattern of the port's coded magnet 10. The cable's coded magnet 10 pattern may be dynamically switched by using electromagnetic maxels 12, which are capable of switching their polarity as a current is applied.

In such an embodiment the coding of the coded magnet 10 may act as an identifier to the cord, indicating the port type and/or type of data transmitted or received by the port. The cord may configure itself accordingly for attachment to the port and/or appropriate data transfer. Further, the cord may include a control line operative to convey information regarding the port and/or data type to a device connected to the other end of the cord, thereby allowing the two devices to synchronize for transmission. Such an embodiment may further include a current or voltage supply line to each of the maxels 12 in its coded magnet 10 surface (or to a subset of maxels 12) to permit the electromagnetic maxels 12 to reconfigure their polarity dynamically.

A similar embodiment may employ a universal port that detects the coded magnet 10 "signature" of a particular cable type and reconfigures itself accordingly. In this embodiment and the foregoing one, the physical connector structure may be a universal one instead of varying by the port and/or cable type.

Figure 2:
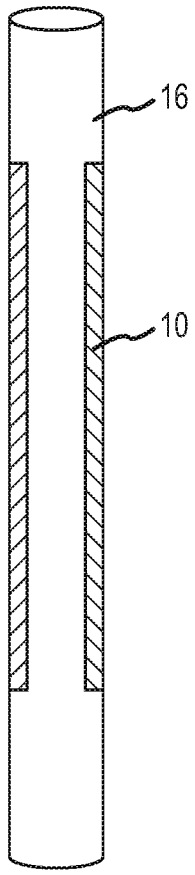
FIG. 2 depicts a cord having coded magnetic structures formed thereon in accordance with an embodiment.

Cables or cords incorporating coded magnetic surfaces may be used to organize, wind, and/or unwind themselves. Consider a group of cords 16, each having a coded magnetic surface 10 in a strip, ring, spiral or other pattern about their exterior as shown in FIG. 2. The cables may be provided with a first coded magnetic 10 structure on a first pattern and a second coded magnetic 10 structure on a second pattern. The two coded magnetic 1—structures may attract one another. By placing the patterns appropriately (for example, on opposing sides of a cord or sufficiently near each other that the cord cannot bend to touch the patterns together), attraction of the cord to itself may be avoided.

Figure 3:
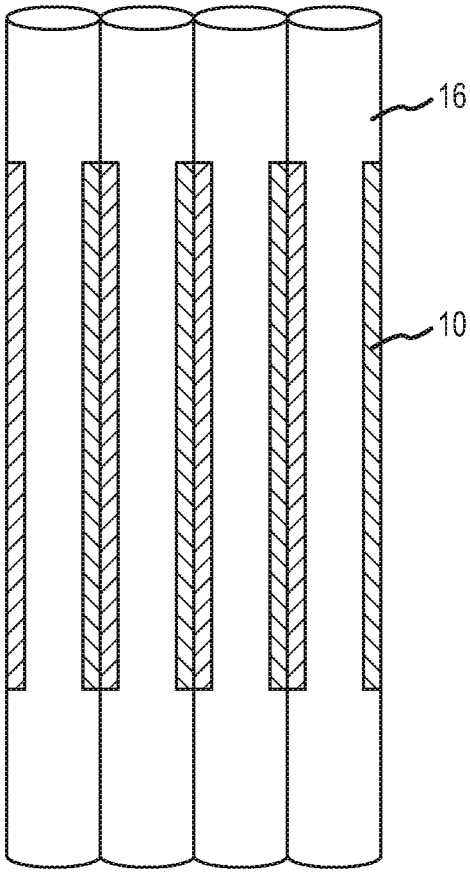
FIG. 3 depicts multiple cords having coded magnetic structures, magnetically locked to one another to form a strip.

However, other cords 16 having the same coded magnetic structures may be attracted to one another. Given proper placement of the patterns on the cords 16, the cords may join together to form a bundle or strip as shown in FIG. 3. This, in turn, reduces clutter as well as the likelihood that the cords knot or kink around one another. Cords 16 may be rotated or slid to disengage from one another. In certain embodiments, the magnetic coding of each pattern may be such that rotating, sliding and/or otherwise moving one cord with respect to another may cause the cords to repulse one another instead of attract.

In still other embodiments, the coded magnetic structures may employ electromagnetic maxels 12. Thus, in a default un-powered state, the coded structures exert no magnetic field at all. When a current is provided to the maxels 12, the coded structures become magnetically active and may attract nearby cords, ports and the like as described above. In this manner, the interaction of the cord may be selectively controlled.

It should be appreciated that variants on the above may be used to implement a self-winding or self-coiling cord or cable. For example, a first coded magnet may be provided at a first end or on a first surface of a cable, a second coded magnet at a second end or second surface, and so on. The first and second coded magnets may attract one another and may be complementary in certain embodiments, as may other pairs of coded magnets on the cable surface. When the coded magnets are electromagnetically switched from a default state, they may attract the corresponding coded magnet (e.g., first to second coded magnet and the like) in order to wind, coil or otherwise structure the cable. The cable may remain magnetically locked in this configuration until the coded magnets are again electromagnetically switched, at which point they may be inert or even repel one another. Alternately, mechanically shifting the positions of the coded magnets with respect to one another may cause them to disengage as previously described. It should be noted that the "default" state of the coded magnets described herein may be a state either where current is or is not applied to the individual maxels.

Input Devices

Figure 4:
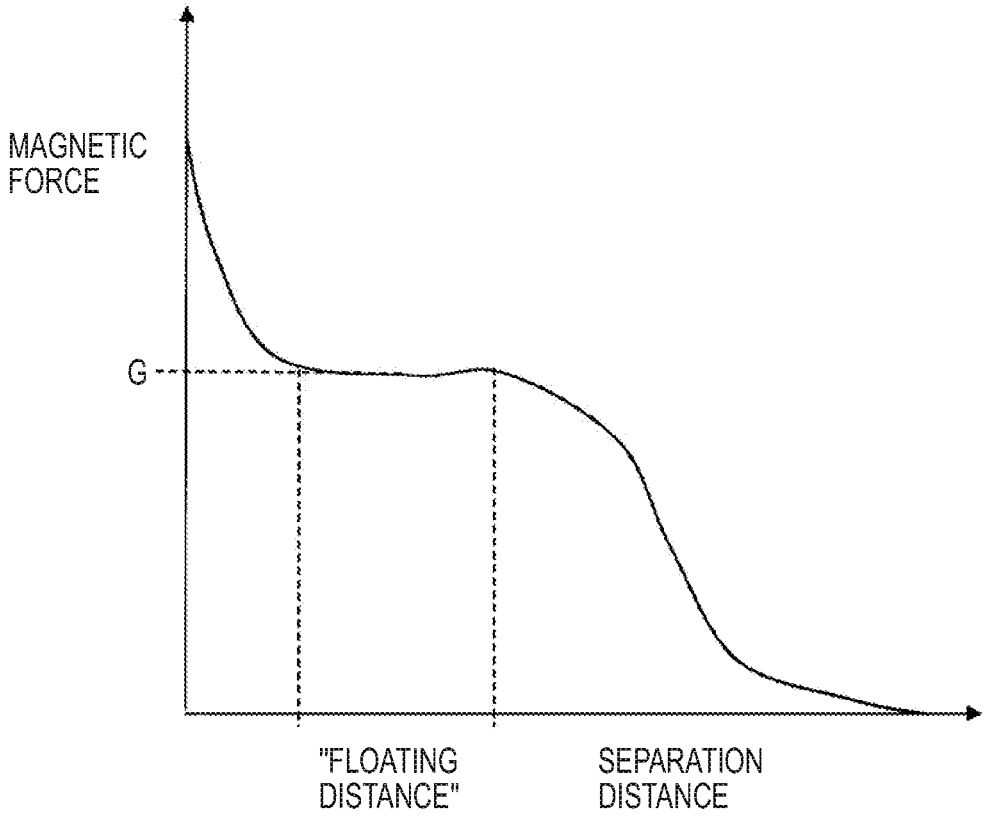
FIG. 4 depicts a sample force curve of a coded magnetic structure used to stably levitate a keycap, in accordance with another embodiment.

A variety of different input devices may be enhanced through the use of coded magnetic surfaces. For example, individual keys of a keyboard may be backed with a coded magnetic structure. Likewise, the surface of the keyboard below each key may have a coded magnetic structure formed thereon that, in conjunction with the coded magnet of the keycap, provides a particular force curve as illustrated in FIG. 4. In alternative embodiments, only one of the keycap and keyboard may utilize a coded magnet while the other is a planar magnet or ferrous material.

At certain points along the force curve of FIG. 4, the magnetic repulsive force will equal the force of gravity G acting on a keycap. That is, at some separation distance between the keycap and keyboard, the repulsive magnetic force will balance out the force of gravity on the keycap. This is shown by the dashed line labeled "G" on FIG. 4. For the range of distances over which the magnetic repulsive force equals G, the keycap will essentially float above the keyboard surface. Properly coded magnetic structures should be sufficient to establish a range of distances over which the magnetic and gravity forces are equal, rather than a single distance. This range of equilibrium distances is labeled "floating distance range" on the graph. If the separation distance between the keycap and keyboard increases, the force due to gravity G overwhelms the magnetic force and the key drops back to the equilibrium distance. Conversely, if a user presses down on the keycap, the magnetic force increases.

This increase in magnetic force, if sufficiently sharp, may be perceived by a user as resistance. The force curve of FIG. 4 can be tailored by properly coding the maxels of the correlated magnetic surface to provide any "feel" desired when the keycap is pressed. For example, if the magnetic repulsive force curve ramps up slowly as separation distance decreases, the floating keycap would feel soft when pressed. Conversely, if the force curve ramps up steeply, the keycap may feel firm. In this manner, the exact haptic feedback experienced by a user interacting with a so-called "floating keycap" may vary in accordance with a designer's or engineer's wishes. In some embodiments, the repulsive force will become sufficiently strong that it resists any casual press or impact on the keyboard at a certain separation distance. When the keycap is released, it will settle back within the floating distance range as the magnetic force repulses the keycap.

A magnetic sensor on the keyboard may detect the increased magnetic flux caused by the keycap approaching the keyboard surface. If the magnetic flux (e.g., magnetic field strength) exceeds a certain threshold, then the keyboard may accept the keycap motion as an input. In this manner, the keyboard may function as normal but be provided with magnetically levitated keys.

It should be appreciated that the foregoing principles may be applied to mice, trackballs, and other input mechanisms as well. Similarly, a magnetic scroll wheel may be incorporated into a mouse such that a sensor measures changes in a magnetic field as the wheel rotates. The scroll wheel may be provided with a ring-shaped coded magnet to facilitate detection of a changing magnetic field; this detection may be used as an input to a corresponding device to indicate the motion of the wheel. Further, since the mouse wheel is magnetically sensed, the mechanical and optical influence of dirt or debris in or near the wheel is irrelevant, presuming the dirt or debris is not metallic or magnetic in nature. Unlike an optical or mechanical sensor that may get jammed with dirt or dust and thus not detect the wheel's motion, dirt/dust has no mechanical or optical effect on sensing changes in a magnetic field caused by rotating a wheel having a properly coded magnetic surface thereon.

In addition, the levitating properties of properly configured correlated magnetic surfaces may be used to align electronic devices with respect to inductive chargers. By adjusting not only a separation distance (e.g., z-axis) but also moving the electronic device toward the optimal inductive charging position within a plane, enhanced charging may be achieved. Correlated magnetic surfaces may be used to rotate and/or laterally move the electronic device relatively easily once it is suspended in midair in the fashion described herein. A series of correlated magnets may cooperate to define a "wall" of repulsive force to hem the device within a particular area, or guide it to the area. Similar techniques may be used to lock a device to a dock for charging, or to align a device with a dock for optical data transmission (for example, in the case of an optical dock).

In a similar fashion, a mouse or other chargeable device may be pushed and/or pulled back to its docking station through the application of coded magnetic surfaces. These coded magnetic surfaces may only activate when the mouse battery falls below a certain level, or when the mouse does not move for a certain time. Battery charge may be monitored by the mouse and relayed to a microprocessor operative to supply voltage to the surfaces' electromagnetic maxels, thus initiating the motion of the mouse towards its charger. Similarly, an associated computing device may determine when the mouse is stationary for a threshold time and activate the electromagnetic maxels once that time is exceeded to push/pull the mouse to the charging station.

Figure 5:
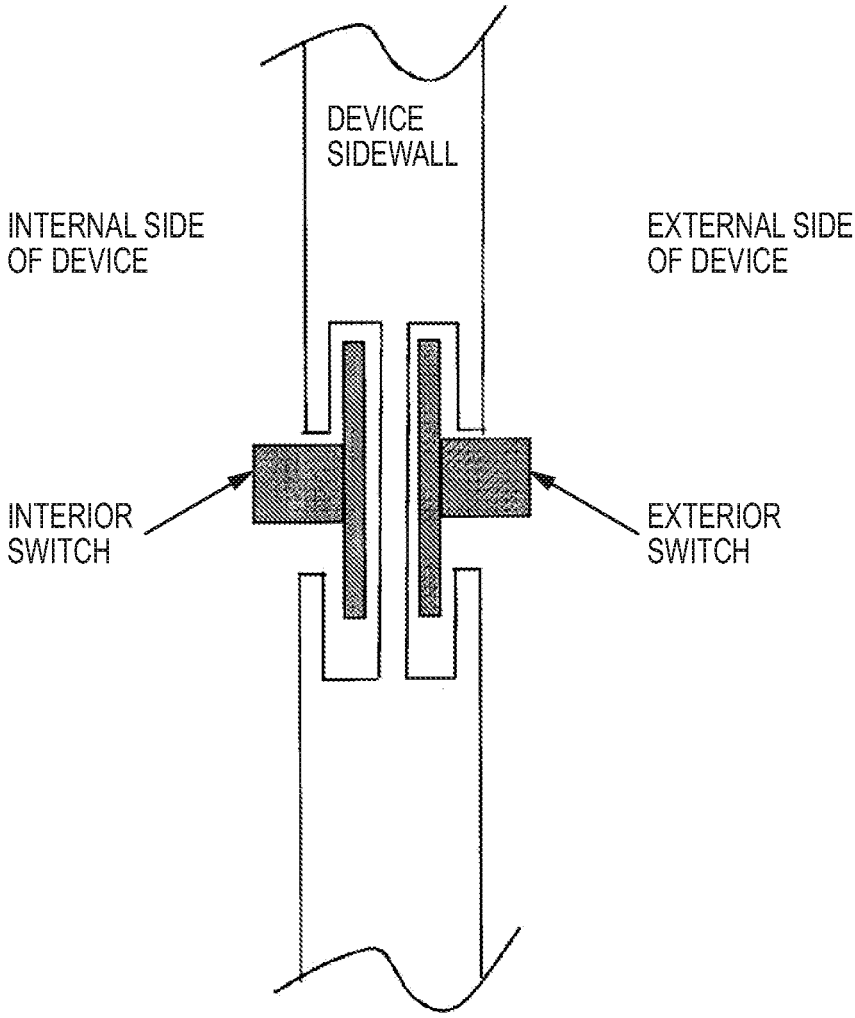
FIG. 5 depicts still another embodiment in the shape of magnetically mated switches.

FIG. 5 depicts a cross-sectional, schematic side view of a waterproof and/or air-tight switch employing magnetic surfaces. Such switches may be useful for devices where water and/or gases should be kept out of the device interior, including computers, portable computing devices, mobile phones, portable music players, network switches, routers and the like, refrigerators and other household appliances, televisions, and so on.

As shown in the figure, an interior switch is located within the internals of the device and an exterior switch is located on the external device side, approximately across from each other and separated by a portion of the device's wall. Each switch may be partially within a cavity formed to restrict motion of the switch, as is known in the art. Alternative methods of ensuring the switch moves only in the manner desired are also contemplated by this document and in alternative embodiments.

The exterior switch includes a coded magnetic surface on its inward-facing portion (e.g., the portion facing the interior switch). Likewise, the interior switch includes a coded magnetic surface on its outward facing surface (e.g., the portion facing the exterior switch). The exterior and interior coded magnetic surfaces may be programmed to resist translational decoupling from one another. Accordingly, as a user drags or moves the exterior switch from a first to a second position, the coded magnetic surfaces cooperate to slide the interior switch in the same direction. Essentially, the exterior and interior switches are magnetically coupled such that motion of one moves the other. In this manner, the interior switch may trigger device functionality even though it is never moved or touched by a user. Since the magnetic coupling forces between switches extend through the sidewall, the interior switch and internal portion of the device may be waterproof and/or hermetically sealed.

In an alternative embodiment, the interior switch may be replaced by a sensor that reads the motion of the maxels on the exterior switch and controls operation of a device accordingly. Thus, as the exterior switch slides, the interior sensor detects the motion and instructs the device to activate, deactivate or provide other functionality (such as controlling audio volume), as appropriate. In this manner, the switch may have no moving internal parts at all. Further, appropriately configuring the external coded magnet may permit the internal switch to detect both the type and distance of any movement.

Other input devices may also be created through the application of coded magnetics. For example, and similar to the embodiment shown in FIG. 5, an external button and internal button may have opposing coded magnetic surfaces. In this case, the surfaces may be repulsive rather than attractive. A spring or other resistive element may bias the internal button forward against the device sidewall; a second spring or resistive element may bias the external button outward.

As a user pushes the external button against the spring, the repulsive magnetic force may likewise push the internal button downward, into the device exterior. After traveling a sufficient distance, the internal button may close a contact, open a contact, or otherwise initiate or terminate some device functionality. A detent or locking mechanism may hold the exterior button in place until a user depresses it or otherwise interacts with the button. The repulsive magnetic force may be sufficient to hold the interior button in place when the external button is stationary. As the external button is depressed, the interior button may rise and terminate device functionality.

It should be appreciated that the programmable force curve that may be achieved with correlated magnets make such a button arrangement feasible, as the force curve may be simultaneously programmed to attract the internal and external buttons to one another when they have too great a separation distance but repulse the buttons from one another when the separation distance grows too small.

Bearings and Motors

Correlated magnets, and the programmable force curves associated with them in particular, may also be used to tune bearings and motors within an electronic device, machinery or other system. If the maxels are electromagnetic, the correlated magnet may provide dynamic tuning capabilities. Certain examples follow.

In mechanically and electrically complex systems, such as a laptop computer or other portable computing device, different system components can interfere with each others' operation. As one example, a moving element such as a fan near another element, like a hard drive, may create a harmonic frequency that disrupts the drive's operation. This is but a single example for purposes of illustration. If feedback from the hard drive (or other element) indicates excessive motion then the fan may be damped by means of an associated, dynamically programmed correlated magnet. The correlated magnet may, for example, repulse the fan or a portion of the fan to change its motion and thus the generated interference. The magnet may likewise attract the fan or a portion thereof. For purposes of attraction and repulsion, certain embodiments may place a second, appropriately coded correlated magnet on a portion of the fan. Further, by dynamically adjusting the polarity of individual maxels, the attractive or repulsive strength of the correlated magnet(s) may be changed on the fly to provide customized damping.

Feedback regarding the hard drive's motion may be gathered from any appropriate sensor, such as a gyroscope or accelerometer. It should be appreciated that the fan and hard drive are used solely to illustrate the principle of dynamic system damping using programmable correlated magnets, and particularly programmable correlated magnets with electromagnetic maxels.

Coded magnets may also be used in a brushless DC motor in order to increase control of angular momentum. Coded magnets may be used, for example, to provide position control to a motor (via the adjustable force curve) without requiring a separate angle encoder for the motor.

Still another example of this will be provided with respect to fans inside a computer case. During shipping, installation and/or assembly, fans may be damaged or pushed off-center such that their rotation becomes erratic and noisy. A programmable correlated magnet may be used to "push" or "pull" the fan back into alignment. Fans may be provided with magnetic bearings to facilitate this operation.

As still another example, coded magnets may be used to buffer a hard drive from a sudden, sharp drop or fall. An accelerometer may detect abrupt motion of the hard drive in a specific direction. If this motion exceeds a threshold, a coded magnet may be activated to push the hard drive away from its enclosure. Given a sufficiently strong repulsive force, the hard drive may be prevented from impacting the enclosure or anything else, thereby reducing the likelihood of damage to data resulting from a dropped or falling laptop.

Further, coded magnets may be used to change the acoustic properties of fans operating in a computer housing, or the acoustic properties of any motorized device. An appropriately coded magnet may intermittently adjust the rotational speed of a fan, thereby preventing the fan from emitting a beat frequency. Further, the coded magnet may adjust the fan speed in such a manner that the fan produces white noise or a noise masking the operation of other components. A microphone may be used as a sensor to determine the fan noise or noise of another component. A microprocessor may use the microphone's output to dynamically adjust the polarity of the coded magnet's maxels to impact the fan's operation as described above.

Assembly of Devices

It should be appreciated that the precise alignment and "homing" that may be achieved with appropriately configured pairs of correlated magnetic surfaces may provide useful functionality for precision assembly of devices. As one example, a laptop computer generally has precise tolerances and positions for all its constituent elements within the laptop chassis. If one element is misplaced, the laptop may not function properly or may not pass a final assembly inspection.

Continuing this example, each element to be placed within a laptop computer may have a coded magnetic surface with a unique magnetic code. A certain position within the laptop chassis may have the complementary or attracting coded magnetic surface. Thus, when the element is near that position, it may self-align at the position. Further, such alignment is not necessarily limited to lateral motion but may include rotational alignment as well. This precision alignment may facilitate construction or assembly of fault-intolerant devices.

Another embodiment may take the form of an assembly tool with a coded magnetic surface that dynamically changes as assembly of a device proceeds, such that the tool mates with the next element to be placed in the assembly process. For a simplified example, consider a screwdriver sized to accept multiple screws of different lengths, head sizes and the like. As assembly of a device proceeds, the screwdriver may receive a command from a computing device overseeing the assembly process to dynamically change the coding of a correlated magnet on the screwdriver tip. An operator may lower the screwdriver into a container of screws and attract to the tool only the screw that has an attractive coded magnetic surface. Thus, the screwdriver may attract only the proper screw for the next assembly step.

This same concept may be applied to automated assembly lines. Essentially, if the assembly tool (such as a robotic arm) can receive feedback regarding the current state of the assembly process, it may dynamically reprogram its correlated magnetic surface to pick up the next piece for placement and put it in the proper area, according to the foregoing disclosure.

Certain embodiments may take the form of a magnetic "rivet" or fastener. The rivet may include multiple splines that are magnetically locked to the rivet body in a withdrawn position. When the rivet is inserted into or through a material, the insertion tool may dynamically deactivate the electromagnetic magnets holding the splines to the body. The splines may thus extend outward behind the material in a fashion similar to an anchor bolt. In alternative embodiments, the tool used to place the rivet may have a coded magnetic surface that attracts the splines to the tool, thereby keeping them flush against the barrel. When the tool is removed, the splines extend. In this embodiment, the magnetic rivet may have a bore into which the tool may fit in order to draw the splines inward against the rivet body.

In addition to assembling devices through the use of coded magnetic surfaces, devices held together by such surfaces may be relatively easily disassembled. Degaussing the device may wipe the coded magnetic surfaces, causing them to no longer attract one another. Thus, at least certain portion of the device may easily separate from one another for breakdown, recycling and the like.

Data Encoding

General concepts of encoded, matching elements facilitated by coded magnetic surfaces were discussed above in the section labeled "Cables." The concepts set forth therein, including dynamic matching of two devices and dynamic reprogramming of one or more coded magnets may be applied to a wide variety of electronic devices.

Still another example of data encoding that may be accomplished through coded magnets with electromagnetic maxels is a "challenge and reply" authentication scheme. For example, a key may be inserted into a lock, a cable into a port, or two devices may sit side by side. In any of the foregoing, both the key and lock/cable and port/first and second device may have a coded magnet surface adjacent one another. One of these two coded magnetic surfaces may be controlled by a microprocessor to rapidly change the polarity of certain maxels in a specific pattern. The other coded magnetic surface may be programmed to change its' maxels' polarity to generate the complement of the first surface's changing pattern. Thus, as both coded magnetic surfaces change with time, they remain magnetically attracted to one another and their corresponding elements coupled to one another. Should either coded magnetic surface fail to change according to the determined pattern, the associated elements may be magnetically repulsed from one another. This may have consequences ranging from ejecting cable from a port, to moving a key out of a lock, to terminating data communication between two computing devices.

In another embodiment, a key may have a coded magnetic surface. The key may be inserted into a lock. Instead of mechanically moving tumblers within the lock, the key may attract or repulse tumblers via the coded magnetic surface. Accordingly, only a key with the proper coded magnetic surface may move the tumblers into the proper position to open the lock. Both polarity and intensity of any given may facilitate moving a tumbler into the proper position. In such embodiments, it should be noted that both the key surface and the lock may be smooth, since mechanical interaction between the key and tumblers is not required. Further, the tumblers may be placed behind a sidewall made from plastic or another material that does not interfere with magnetic fields, thus reducing the likelihood that the lock may be picked.

Similar principles may be used to identify two devices to one another through dynamically programmable coded magnets. The changes in the coded magnet's field may correspond to an identification sequence for a particular device. Further, devices equipped with magnetic sensors may detect other devices with coded magnetic surfaces. The magnetic surface may be coded to act as a device identifier when static; the resulting magnetic field may be unique and detectable by nearby devices. Thus, a device sufficiently near another device to detect the magnetic fields of the adjacent device's coded magnetic surface may read this data as a serial number or other identifier for the adjacent device.

Yet another embodiment may employ matching coded magnetic surfaces to transmit data. The electromagnetic maxels may vary their polarities to transmit data to a magnetically sensitive sensor. Essentially, since the maxels may be programmed to binary in nature (e.g., either showing a north or south pole, depending on current), each maxel may transmit binary sequences to an appropriately-configured sensor. Likewise, multiple maxels adjacent one another may cooperate to transmit longer binary codes simultaneously. If the maxels of a correlated magnetic surface are used for such a purpose, it may be desirable to have fixed magnets with a higher magnetic flux than that of the maxels to ensure the cable stays mated to the port (or the two devices to one another, and so forth). A mechanical mating may be used in certain embodiments.

Latches

Certain embodiments may also take the form of a latch or closing mechanism for an electronic device, box or other item that may be opened and closed. One example of such a device is a laptop computer. A first correlated magnet may be placed at a lip or edge of a device enclosure, typically in a position abutting the top or lid of the device when the device is in a closed position. A second magnet may be located in the lid and generally adjacent the first correlated magnet when the device is closed. The first and second correlated magnets may be coded to attract one another when the separation distance is below a threshold and repulse one another when the separation distance exceeds the threshold. Thus, the correlated magnets may assist in opening or closing the device, depending on the separation distance. The magnets may have sufficient attractive force below the separation threshold to automatically pull the device closed in certain embodiments.

Another embodiment may place multiple coded magnets in the clutch (e.g., hinge) of a laptop computer or similar device. One coded magnet may be in the portion of the clutch engaged with the base of the laptop and one on the clutch portion engaged with the top of the laptop. The magnets may be coded to rotationally repulse one another until a certain rotational alignment is achieved, at which point the magnets may be coded to attract one another. In this fashion, the circular coded magnets may act as a detent to hold the device top open in a particular position with respect to the device base. The coded magnets may have multiple such virtual detents to permit a user a range of options for opening and/or closing the device.

Ferrofluids

Various embodiments may employ coded magnets with ferrofluids to achieve a variety of effects. Ferrofluids are generally liquids that become strongly polarized in the presence of a magnetic field. Ferrofluids may thus be attracted and repulsed by magnetic fields.

Certain embodiments may employ coded magnets to attract or repulse ferrofluids to place ferrofluids in a particular place at a particular time. As one example, a coded magnet may be activated when a proximity sensor detects a finger approaching a touchpad or other surface capable of detecting a touch. (The exact mechanics of how the surface detects the touch are irrelevant; the present disclosure is intended to encompass capacitive sensing, IR sensing, resistive sensing and so on.) As the finger (or other object) approaches the surface, the proximity sensor's output may activate a coded magnet beneath the portion of the surface about to be impacted. This coded magnet may draw ferrofluid to it, resulting in an upper portion of the surface rising or bulging. In this manner, the touch-sensitive surface may provide visual and/or haptic feedback indicating the touch has been sensed. Haptic feedback may be achieved because the feel of touching the ferrofluid-filled bulge would be different than touching the flat touch-sensitive surface. Further, it should be appreciated that the sensing algorithms and/or capabilities of the surface may be adjusted to account for the pool of ferrofluid.

Yet another embodiment may apply the foregoing principles to a touch-sensitive keyboard with a flat surface. Keys may be inflated by attracting ferrofluid to the appropriate key just before or as the key is touched. In such an embodiment, a maxel may be located beneath each key with the maxels beneath all keys (and, possibly, other areas of the keyboard) forming the coded magnet. It should be appreciated that the coded magnet underlying the keyboard may be dynamically programmed to direct ferrofluid where necessary and repulse ferrofluid from other areas. Thus, upon sensing an imminent touch, the polarities of more maxels than merely the one underlying the key to be touched may change. As one example, the maxels may change polarities in order to drive ferrofluid beneath the key in question, then changed again to drive ferrofluid out from beneath any key other than the one about to be touched.

Insofar as ferrofluids are generally opaque, certain embodiments may employ coded magnets to attract or repulse ferrofluids beneath or within an input or output device to alter the translucence of the device. For example, a certain amount of ferrofluid may be drawn beneath a transparent surface with a backlight. The ferrofluid may be repulsed from a particular point beneath that surface but maintained in all other areas, thereby creating a lighter point on the surface to indicate where a user should touch or interact with the device.

Yet another embodiment may employ correlated magnets and a ferrofluid as elements of a cooling system. Liquid cooling systems are commonly employed in electronic devices to remove heat from certain elements, such as processors. Ferrofluids are used in certain thermal cooling systems; as a ferrofluid is heated, its magnetic qualities decrease (e.g., it becomes less attracted to a magnet). Thus, a magnet near an element to be cooled will attract ferrofluid which will be heated by the element, thereby becoming less magnetically sensitive. The heated ferrofluid will flow away from the magnet and be replaced by cool ferrofluid. This cycle may continue indefinitely.

By using a dynamically programmable correlated magnet (e.g., one with electromagnetic maxels), the magnetic attraction and/or repulsion of ferrofluid to hot spots or elements within an electronic device may be enhanced. Thus, as certain areas or element heat up, more ferrofluid may be diverted to that area to enhance cooling.

Other Embodiments

Various other embodiments may use correlated magnets to achieve a variety of effects and implement certain features. As one example, an electronic device (e.g., a laptop, audio/video receiver, other computer, portable computing device, television, monitor and the like) may employ correlated magnets to provide active valving for thermal management. Many electronic devices have dedicated airflow paths to move air masses to and/or through particular areas for cooling. Typically, these paths are static and passive-they direct however much airflow is provided to them and cannot change the flow paths.

In one embodiment, coded magnets may be used to open or close louvers in the airflow paths, thus shutting off and/or redirecting air within the electronic device enclosure. The coded magnets may be electromagnetically programmed to open and/or close louvers as necessary to route air from a fan to a particular portion of the device enclosure. For example, the outputs of various thermal sensors may be used to determine where more airflow is necessary to cool a hot internal element or area, and the coded magnets may be reprogrammed on the fly to attract and/or repulse the louvers to direct the airflow accordingly. In some embodiments, the airflow ducts, louvers and magnets may be formed in a separate layer so that the louvers may move freely without impacting other internal components.

As still another option, the foregoing may be applied to magnetically lower louvers across exhaust and/or air intake ports when no or minimal cooling is needed. Likewise, the louvers may be magnetically raised by the electromagnetic coded magnets when air intake and/or exhaust is desired. Further, because the coded magnets may be electromagnetically reprogrammed in real-time, the distance to which the louvers open (and thus the amount of air let in or exhausted) may likewise be controlled.

Still another embodiment may employ correlated magnets to cool electronic components within an enclosure via the magnetocaloric effect. The coded magnet may control this effect and/or act as a heat pump to shift heat through the enclosure as necessary. The magnetocaloric effect generally employs a changing magnetic field in certain alloys to decrease the surface temperature of that alloy, as known in the art.

Still another embodiment may employ correlated magnets to track the motion of a stylus on a screen, trackpad or other surface. The stylus may have a magnetic sensor located thereon that may detect the unique magnetic fields produced by coded magnets. By placing a number of coded magnets beneath the surface, the stylus may read the unique magnetic field of each coded magnet and thereby know its relative position on the surface. The stylus may relay this information to an associated electronic device to permit the device to know the stylus' location. Such information may be transmitted wirelessly or over a wired connection.

Alternately, the surface may have a number of magnetic sensors located beneath it and the stylus may have a unique magnetic signature generated by a coded magnet located on the stylus (for example, at the tip of the stylus). The magnetic sensors may thus track the motion of the stylus and sense its location relative to the surface.

Coded magnets may also be used as speaker actuators and provide additional speaker control. For example, if the speaker actuator is a coded magnet, it may also function as a sensor to determine the position of the speaker driver. This data may be used as part of a feedback control loop to improve accuracy of the driver.

Yet another embodiment may incorporate correlated magnets to detect when a lithium-ion polymer battery swells. As these types of batteries age and are used, they may thicken and/or warp. In electronic device enclosures with strict tolerances, this may lead to a risk of fire if the internals of the battery are punctured due to battery motion, thickening, warping and so on. A correlated magnet pair (one on the battery and one nearby) may be used to sense the position of the battery. The correlated magnet not on the battery may detect a change in the magnetic field strength and/or polarity as the battery swells and the correlated magnet thereon moves accordingly. If this change is sensed, the electronic device may disable the battery. As yet another option, as the field strength of the correlated magnet increases, it may flip a magnetic switch that disables the battery.

Generally, embodiments discussed herein have presumed that the maxel array of the coded magnet has the maxels positioned at uniform distances from one another, or adjacent to one another. It should be appreciated that the force curve of a coded magnet may be adjusted by changing the spacing of individual maxels as well as changing the polarity and/or magnetic strength of the maxels. Certain embodiments may even employ maxels that may be shifted in one or more dimensions to dynamically adjust the aforementioned force curve to achieve a variety of effects, including those listed herein.

Electronic devices may employ correlated magnets to enable and disable power buttons. Many users accidentally press the power buttons of their electronic devices when using them, which may lead to a loss of data or interruption of use when the device is on. This may be avoided through the use of at least one correlated magnet.

As an example, presume an electromagnetic correlated magnet is located beneath a metal or magnetic power button. The correlated magnet may be off until the device is turned on via the button, at which point the electromagnetic maxels of the correlated magnet are activated. At this point, the correlated magnet may repulse the power button and thus prevent it from being pushed in, which in turn prevents the user from accidentally powering down the device. The correlated magnet may stay powered on until a certain condition is met. One example of such a condition is that the user ceases to interact with the device in any fashion for a minimum time. Another is that the device fails to provide any output for a minimum time.

Regardless, once the condition is met, the correlated magnet may be depowered, thereby permitting the user to depress the power button and turn off the device.

Magnetic ID Tags

Certain embodiments may employ coded magnets as identification tags. Devices with appropriately configured magnetic sensors (and/or coded magnets of their own, which may function as magnetic sensors) may detect the magnetic field of a nearby coded magnet. This magnetic field may act as a "signature" to identify the coded magnet and an object associated with it. Thus, the coded magnet may function as a sort of close-proximity identification chip, but without requiring any active broadcast or mechanical connection.

As one example, a museum may include multiple coded magnets at or near each exhibit; each coded magnet may generate a unique magnetic field. As a visitor approaches the exhibit, the user's electronic device may detect the magnetic field and compare it to a master database downloaded onto the device upon entering the museum. The device may match the magnetic field to an entry in the database and retrieve information from the database associated with the field. The electronic device may display this information to the visitor, thus allowing him or her to appreciate the exhibit without requiring him or her to dock the device to a connector or receive any broadcast. This process may be applied in other venues, as well.

Keys and access cards may likewise incorporate coded magnets to permit or deny entry. A user's access card may have a unique magnetic signature that may be recognized by a card reader, which may allow or deny entry based on that signature.

Although this document lists several concepts, methods, systems and apparatuses using correlated magnets, it should be appreciated by those of ordinary skill in the art that the contents of this document may be readily adapted to various other embodiments without requiring any inventive step. Accordingly, the concepts, methods, systems, apparatuses and the like discussed herein are provided by way of illustration and not limitation.

We claim:

1. A plug for connecting a first device to a second device comprising:

a first electrical contact;

a first coded magnet that interacts with a first device coded magnet of the second device according to a dynamically programmable force curve, the first coded magnet comprising a plurality of magnetic elements; wherein a polarity of each of the plurality of magnetic elements is individually dynamically controllable; and at least one of the plurality of magnetic elements is operable to alter polarity to repulse the first device coded magnet away from the first coded magnet.

2. The plug of claim 1, wherein the first coded magnet exerts a force to pull the plug towards the first device coded magnet.

3. The plug of claim 1, further comprising:

a second electrical contact; and a second coded magnet configured to interact with a second device coded magnet of the second device according to a dynamically programmable force curve.

4. A method for receiving the plug of claim 1 within a port comprising:

analyzing a magnetic force of a first coded magnet of the plug;

determining if the first device coded magnet has a force curve complementary to a device force curve of a first device coded magnet of the port; and if the first coded magnet and the first device coded magnet have complementary force curves, exerting a force on the first coded magnet to pull the first coded magnet towards the first device coded magnet.

5. The method of claim 4, further comprising:

analyzing the magnetic force of the first coded magnet of the plug to determine if the plug is aligned with the port; and if the plug is not aligned with the port selectively alternating the force curve of the first device coded magnet or the first coded magnet.

6. The plug of claim 1, wherein the at least one of the plurality of magnetic elements alters the polarity to repulse the first device coded magnet away from the first coded magnet when an activity related to connection of the first device to the second device completes.

7. The plug of claim 6, wherein the activity includes at least one of a charge activity, a sync activity, a data transfer activity, or a communication activity.

8. The plug of claim 1, wherein the at least one of the plurality of magnetic elements alters the polarity to repulse the first device coded magnet away from the first coded magnet when at least one of the first device or the second device exceeds a temperature threshold, 9. The plug of claim 1, wherein the at least one of the plurality of magnetic elements alters the polarity to repulse the first device coded magnet away from the first coded magnet when a fault occurs related to the connection of the first device to the second device, 10. The plug of claim 1, wherein the at least one of the plurality of magnetic elements alters the polarity to repulse the first device coded magnet away from the first coded magnet to provide a notification related to the connection of the first device to the second device.

11. A method for ejecting a plug from a port of an electronic device, the port having a first port coded magnet comprising:

receiving a plug with a first plug coded magnet and a first contact into the port;

activating by the electronic device a first process and electronically communicating with the first contact of the plug;

determining whether the first process is complete; and if the first process is complete, altering a force curve of the first port coded magnet to repel the first plug coded magnet and at least partially eject the plug from the port.

12. The method of claim 11, wherein the first process is one of a data synchronization or a battery charging process.

13. The method of claim 11, further comprising:

activating by the electronic device a second process and electronically communicating with a second contact of the plug; wherein if the first process is complete and the second process is not complete, partially ejecting the plug so that the second contact remains in communication with the port.

14. The method of claim 13, further comprising:

determining whether the second process is complete; and if the second process is complete altering the force curve of a second port coded magnet to repel a second plug coded magnet of the plug and ejecting the plug from the port.

15. The method of claim 11, further comprising:

determining whether a select threshold of the device has been reached; and if the threshold has been reached altering the force curve of the first port coded magnet to repel the first plug coded magnet and ejecting the plug from the port.

16. The method of claim 15, wherein the threshold is a temperature threshold.

17. An electronic device comprising:

a port that receives a cable and including a first programmable magnet having a plurality of magnetic elements and a port maxel pattern, a polarity of each of the plurality of magnetic elements being individually dynamically controllable; wherein if the cable has a complementary cable maxel pattern to the port maxel pattern, the port accepts the cable;

if the cable has a non-complementary cable maxel pattern to the port maxel pattern, the port rejects the cable; and at least one of the plurality of magnetic elements is operable to alter polarity to repulse the cable away from the port.

18. The electronic device of claim 17, wherein the port maxel pattern has a dynamically programmable force curve.

19. The electronic device of claim 17, wherein the electronic device is a computer.

20. The electronic device of claim 17, wherein the port further comprises at least one electrical contact that communicates between the cable and the electronic device.

21. The electronic device of claim 20, wherein if the cable has a complementary cable maxel pattern the port is further configured to activate a first process and electronically communicate with the at least one electrical contact of the plug; and when the first process is complete, alerting the port maxel pattern to be non-complementary to the cable maxel pattern to at least partially eject the cable from the port.

22. The electronic device of claim 17, wherein if the cable maxel pattern is complementary to the port maxel pattern the port maxel pattern exerts a force on the cable maxel pattern to pull the cable towards the port.

23. The electronic device of claim 17, wherein if the cable maxel pattern is non-complementary to the port maxel pattern the port maxel pattern exerts a force on the cable maxel pattern to repulse the cable away from the port.

24. The electronic device of claim 17, wherein the port alters the port maxel pattern to selectively repulse the cable from the port.

25. The electronic device of claim 17, wherein the at least one of the plurality of magnetic elements alters the polarity to repulse the cable away from the port when at least one of an activity related to connection of the cable to the port completes, the electronic device exceeds a temperature threshold, or when a fault occurs related to the connection of the cable to the port.

26. The electronic device of claim 17, wherein the at least one of the plurality of magnetic elements alters the polarity to repulse the cable away from the port to provide a notification related to the connection of the cable to the port.

27. A cable for communicating between a first electronic device and a second electronic device comprising:

a first electrical contact; and a first programmable magnet with a dynamically programmable force curve, the first programmable magnet including a plurality of magnetic elements wherein a polarity of each of the plurality of magnetic elements is individually dynamically controllable;

wherein at least one of the plurality of magnetic elements is operable to alter polarity to repulse a second magnet away from the first programmable magnet.

28. The cable of claim 27, wherein the at least one of the plurality of magnetic elements alters the polarity to repulse the second magnet away from the first programmable magnet when at least one of an activity related to communication between the first electronic device and the second electronic device completes, at least one of the first electronic device or the second electronic device exceeds a temperature threshold, or when a faith occurs related to the communication between the first electronic device and the second electronic device.

29. The cable of claim 27, wherein the at least one of the plurality of magnetic elements alters the polarity to repulse the second magnet away from the first programmable magnet to provide a notification related to the communication between the first electronic device and the second electronic device.

* * * * *